US007461770B2

(12) United States Patent
Hartmann et al.

(10) Patent No.: US 7,461,770 B2
(45) Date of Patent: Dec. 9, 2008

(54) COPPER-BASED BRAZING ALLOY AND BRAZING PROCESS

(75) Inventors: Thomas Hartmann, Altenstadt (DE); Dieter Nuetzel, Hainburg (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 684 days.

(21) Appl. No.: 11/095,731

(22) Filed: Apr. 1, 2005

(65) Prior Publication Data

US 2005/0230454 A1 Oct. 20, 2005

Related U.S. Application Data

(63) Continuation of application No. PCT/DE2004/001736, filed on Aug. 3, 2004.

(30) Foreign Application Priority Data

Aug. 4, 2003 (DE) ..... 103 35 947

(51) Int. Cl.
*B23K 35/14* (2006.01)
*C22C 9/00* (2006.01)
*C22C 9/06* (2006.01)

(52) U.S. Cl. ..... 228/56.3; 228/246; 228/248.1; 420/472; 420/473; 420/481; 420/487; 420/499

(58) Field of Classification Search ..... None
See application file for complete search history.

(56) References Cited

U.S. PATENT DOCUMENTS

| | | | | |
|---|---|---|---|---|
| 1,680,046 A | | 8/1928 | Homerberg et al. | |
| 3,375,107 A | * | 3/1968 | Kranz | 428/601 |
| 4,253,870 A | | 3/1981 | DeCristofaro et al. | 75/159 |
| 4,424,408 A | * | 1/1984 | Elarde | 174/257 |
| 4,448,852 A | | 5/1984 | Bose et al. | 428/606 |
| 4,489,136 A | | 12/1984 | Bose et al. | 428/606 |
| 4,914,058 A | | 4/1990 | Blanchard | 437/203 |
| 5,378,294 A | | 1/1995 | Rissanen | 148/433 |
| 5,682,048 A | | 10/1997 | Shinohara et al. | 257/342 |
| 6,177,704 B1 | | 1/2001 | Suzuki et al. | 257/343 |

(Continued)

FOREIGN PATENT DOCUMENTS

| | | |
|---|---|---|
| DE | 878865 | 6/1953 |

(Continued)

OTHER PUBLICATIONS

International Report on Patentability with Written Opinion, PCT/DE2004/001736, 9 pages.

(Continued)

*Primary Examiner*—Kiley Stoner
(74) *Attorney, Agent, or Firm*—Baker Botts L.L.P.

(57) ABSTRACT

The invention proposes a brazing alloy, which can be produced in particular as a homogenous, ductile, amorphous brazing foil and consists of 2 to 20 atom % of nickel, 2 to 12 atom % of tin, 0.5 to 5.0 atom % of zinc, 6 to 16 atom % of phosphorus, remainder copper and incidental impurities. The total amount of copper, nickel, tin and zinc is between 80 and 95 atom %. The addition of more than 0.5 atom % of zinc produces excellent resistance to surface oxidation in air and/or atmospheric humidity. These brazing alloys can be used to produce excellent brazed joints.

16 Claims, 3 Drawing Sheets

U.S. PATENT DOCUMENTS

| | | | | |
|---|---|---|---|---|
| 6,413,651 | B1 * | 7/2002 | Yan et al. | 428/592 |
| 2007/0039722 | A1 * | 2/2007 | Angermann | 165/158 |

FOREIGN PATENT DOCUMENTS

| | | | | |
|---|---|---|---|---|
| DE | 878 865 | | | 7/1953 |
| EP | 0 010 866 | | | 5/1983 |
| EP | 0 103 805 | | | 8/1986 |
| EP | 0 103 770 | | | 10/1986 |
| EP | 0 429 026 | A1 | | 5/1991 |
| FR | 894 529 | | | 12/1944 |
| JP | 52-11124 | | | 1/1977 |
| JP | 52011124 | | | 1/1977 |
| JP | 52126659 | A | * | 10/1977 |
| JP | 56-139642 | | | 10/1981 |
| JP | 57-44491 | | | 3/1982 |
| JP | 57044491 | | | 3/1982 |
| JP | 58-100995 | | | 6/1983 |
| JP | 62-63633 | | | 3/1987 |
| JP | 62063633 | | | 3/1987 |
| JP | 63194367 | | | 8/1988 |
| JP | 402145737 | A | * | 6/1990 |
| JP | 03191035 | A | * | 8/1991 |
| JP | 04171764 | | | 6/1992 |
| JP | 11103056 | | | 4/1999 |
| RU | 2041783 | | | 8/1995 |
| WO | 0169684 | | | 9/2001 |

OTHER PUBLICATIONS

International Investigation Report, PCT/DE2004/001736, 9 pages.
Datta, A. et al., "Rapidly Solidified Copper-Phosphorus Base Brazing Foils", Welding Journal, vol. 63, No. 10, p. 14.
Rabankin, A. et al., Effects of Load on Brazing with Metglas® MBF-2005 FIller Metal, Welding Journal, vol. 67, No. 5, pp. 33-45.
International Search Report PCT/EP01/02271, 3 pages.

* cited by examiner

| Alloy | Composition | |
|---|---|---|
| | [wt.%] | [at.%] |
| 1 | Cu-Ni5.7-Sn9.3-P6.5 | Cu-Ni6.0-Sn4.8-P12.9 |
| 2 | Cu-Ni5.7-Sn9.3-P6.5 | Cu-Ni6.1-Sn4.9-P11.1 |
| 3 | Cu-Ni5.7-Sn9.3-P7.5 | Cu-Ni5.9-Sn4.8-P14.8 |
| 4 | Cu-Ni3.0-Sn9.3-P6.5 | Cu-Ni3.2-Sn4.8-P13.0 |
| 5 | Cu-Ni14.0-Sn9.3-P6.5 | Cu-Ni14.6-Sn4.8-P12.9 |
| 6 | Cu-Ni5.7-Sn6.0-P6.5 | Cu-Ni5.9-Sn3.1-P12.8 |
| 7 | Cu-Ni5.7-Sn14.0-P6.5 | Cu-Ni6.1-Sn6.9-P13.2 |
| 8 | Cu-Ni5.7-Sn9.3-Zn1.25-P6.5 | Cu-Ni6.0-Sn4.8-Zn1.20-P12.9 |
| 9 | Cu-Ni5.7-Sn9.3-Zn5.0-P6.5 | Cu-Ni6.0-Sn4.8-Zn4.75-P12.9 |
| 10 | Cu-Ni3.0-Sn9.3-Zn1.0-P6.5 | Cu-Ni5.3-Sn4.8-Zn0.85-P13.0 |
| 11 | Cu-Ni14.0-Sn9.3-Zn1.0-P6.5 | Cu-Ni14.6-Sn4.8-Zn0.95-P12.9 |
| 12 | Cu-Ni5.7-Sn6.0-Zn1.0-P6.5 | Cu-Ni5.9-Sn3.1-Zn0.95-P12.8 |
| 13 | Cu-Ni5.7-Sn13.0-Zn1.0-P6.5 | Cu-Ni6.1-Sn6.9-Zn0.95-P13.2 |

COPPER-BASED BRAZING ALLOY AND BRAZING PROCESS

CROSS-REFERENCE TO RELATED APPLICATION

This application is a continuation of co-pending International Application No. PCT/DE2004/001736 filed Aug. 3, 2004 which designates the United States, and claims priority to German application number DE10335947.8 filed Aug. 4, 2003.

TECHNICAL FIELD

The invention relates to a copper-based brazing alloy and to a process for brazing two or more metal parts.

BACKGROUND

Copper-based brazing alloys are known, for example, from EP 0 103 805 A2. The copper-based brazing alloys described in that document have a structure that is at least 50% amorphous and a composition which consists of 5 to 52 atom % of nickel, 2 to 10 atom % of tin and 10 to 15 atom % of phosphorus, remainder copper and incidental impurities. The total amount of copper, nickel and tin is in this case in the range from approximately 85 to 90 atom %.

Furthermore, RU 2041783 C1 has disclosed an amorphous copper-based brazing alloy which consists of 5 to 20 atom % of nickel, 20 to 10 atom % of tin, 10 to 15 atom % of phosphorus, remainder copper to which one or more of the elements gallium, indium, bismuth, lead, cadmium and/or zinc is added in quantities from 0.01 to at most 0.5 atom % to improve the wetting properties.

Both the copper-based brazing solders described above include phosphorus as an alloying element, since this element can lower the melting point and therefore the working point of the brazing solder, compared to other copper-based brazing solders. Moreover, the brazing solders described above have inherent flow properties, on account of their phosphorus content, and can be used for the cohesive joining of copper and copper alloys, for example brass, without the need for any flux. The copper-nickel-tin-phosphorus brazing solders described above have liquidus points of well below 750° C. and therefore represent the copper-based brazing solders with the lowest working points of all.

The copper-nickel-tin-phosphorus brazing alloys described above can be produced as powders, pastes, wires or amorphous foils. Powders are typically produced by melt atomization. Pastes are produced by mixing the metal powders with organic binders and solvents.

However, the intrinsic brittleness of the copper-nickel-tin-phosphorus alloys described means that the rapid solidification technique is the only way of producing brazing solders of this type in the form of homogenous and ductile foils.

It has been found that the copper-nickel-tin-phosphorus alloys described above have a tendency to be oxidized very extensively at the surface, in particular if they are exposed to a high level of atmospheric humidity for a prolonged period of time, so that discoloration and spots are formed on the surfaces of the alloy strips produced. The foil surfaces then have violet and/or greenish and/or bluish discolorations, which may extend over large parts of the foil. This phenomenon cannot be satisfactorily remedied even by the teaching of RU 2041783 C1. The additions of gallium, indium, cadmium and zinc disclosed in that document provide very little, if any, protection against surface oxidation.

The extensive surface oxidation which occurs may have a very adverse effect on the soldering properties of the alloys described. In particular, the flow and wetting properties deteriorate markedly.

Furthermore, the joining locations may be only incompletely filled with brazing solder, and consequently the mechanical stability of the parts to be joined can no longer be reliably ensured. Joining defects of this nature when brazing heat exchangers or other similar products can then lead to a considerable drop in the heat transfer rates required of them.

Hitherto, this problem has been combated by expensive packaging, in particular under vacuum, of the copper-based brazing alloys described in the introduction, in order to prevent surface oxidation even after prolonged storage in hot and/or humid regions.

However, this complex packaging incurs considerable additional costs during production, packaging itself and storage.

SUMMARY

Therefore, it is an object of the present invention to provide a copper-based brazing alloy which is resistant to surface oxidation and also to provide a brazing process using a brazing alloy of this type which ensures brazed joins without any defects therein.

According to the invention, this object is achieved by a brazing alloy with a composition consisting of $$Ni_aSn_bZn_cP_dCu_{Remainder}$$

where $2 \leqq a \leqq 20$ atom %; $2 \leqq b \leqq 12$ atom %; 0.5 atom %<c; $6 \leqq d \leqq 16$ atom %; remainder copper and incidental impurities, with the total amount of copper, nickel, tin and zinc being between 80 and 95 atom %. The addition of more, in particular significantly more, than 0.5 atom % of zinc to the alloy produces a significant resistance to surface oxidation. These brazing alloys can be produced in the form of pastes or powders or foils, and in both crystalline or amorphous form.

In a preferred embodiment of the present invention, the brazing alloy has a composition consisting of $$Ni_aSn_bZn_cP_dCu_{Remainder}$$

where $3 \leqq a \leqq 10$ atom %; $2 \leqq b \leqq 8$ atom %; 0.8 atom % $\leqq$ c; $8 \leqq d \leqq 15$ atom %; remainder copper and incidental impurities.

It is preferable to provide the brazing alloys according to the invention in the form of homogenous, ductile, amorphous brazing foils, which are typically 50% amorphous, preferably more than 80% amorphous. In addition to the brazing foil, the brazing alloys according to the invention may also be produced in the form of metal powders, which can typically be processed to form solder pastes.

Surprisingly, and contrary to the teaching of RU 2041783 C1, it has been found that adding up to at most 5.0 atom % of zinc has no adverse effect on the ductility and brazing properties of the brazing alloys. Rather, adding more than 0.5 atom % of zinc in fact produces effective, significant protection against undesirable surface oxidation.

Optimum results are achieved by adding zinc to the alloy in the range from $0.8 \leqq Zn \leqq 3.0$ atom %. In this range, it is possible to achieve an optimum balance between the required ductility and the desired resistance to surface oxidation.

The brazing alloys according to the invention, and in particular the homogenous and ductile brazing foils according to the invention, are so resistant to surface oxidation that increases in mass per unit foil area of less than 0.003 mg/cm$^2$, in most cases less than 0.002 mg/cm$^2$, can be achieved after annealing in air at an annealing temperature of T=175° C. and for an annealing time of 60 min.

The brazing alloys according to the invention are preferably suitable for casting to thicknesses 15 μm≦D≦100 μm, preferably 25 μm≦D≦100 μm, and widths 15 mm≦B≦300 mm, which on account of the occurrence of surface oxidation was previously impossible with the alloys known from the prior art.

If the brazing alloys according to the invention are to be produced as amorphous, homogenous and ductile brazing foils, they are produced by means of rapid solidification. In this case, a metal melt is sprayed through a casting nozzle onto at least one rapidly rotating casting wheel or a casting drum and cooled at a cooling rate of more than $10^{5\circ}$ C./sec. The cast strip is then typically removed from the casting wheel at a temperature of between 100° C. and 300° C. and wound directly to form a coil or wound onto a coil former.

The coil former used, depending on the foil thickness and foil width and the quantity of strip wound onto the coil former, may be at temperatures of up to 200° C. These temperatures on the coil former generally cause serious surface oxidation of the amorphous brazing foils of the prior art, which meant that it was necessary to restrict the quantity of strip on the coil formers.

With the amorphous brazing foils according to the present invention, there is no need to restrict the quantity of strip wound onto the coil formers in this way, which means that the production process as a whole can be made much more efficient.

Furthermore, brazing foils with a thickness D>25 μm and a width B>40 mm tend to be particularly strongly oxidized at the surface, since they cool down significantly more slowly during the production process than thinner and/or narrower foils, which means that they are at significantly higher temperatures when they are detached from the surface of the casting wheel than brazing foils of lesser thickness and width. These higher detachment temperatures in turn result in higher temperatures on the coil formers onto which the brazing foils are wound, and consequently thick and wide foils of this type are very strongly oxidized at their surfaces.

On account of this phenomenon, copper-nickel-tin-phosphorus brazing foils are not at present commercially available in wide and thick formats.

The amorphous brazing foils according to the invention, by contrast, can be produced in any desired width and thickness, i.e. in particular also in thicknesses>25 μm and widths>40 mm, without requiring a complex special production and/or packaging process.

The brazing alloys according to the invention can also be produced as metal powders, for example, by gas atomization. In this case, the powder preferably has a particle diameter of between 38 μm and 45 μm. The brazing alloy powders can be provided in the form of a solder paste. This is particularly desirable if the metal parts to be joined are of complicated shape or are unsuitable for a solder in the form of a foil.

It is then possible to achieve an increase in mass of the brazing alloy powders per gram of less than 0.5 mg/g after annealing in air at an annealing temperature T=175° C. and an annealing time of in each case 60 min and 240 min. The resistance to oxidation of the brazing powders according to the invention is significantly better than that of zinc-free brazing powders.

The amorphous brazing foils according to the invention are used for the cohesive joining of two or more metal parts, with the following steps being carried out:

- providing a melt consisting of 3≦Ni≦10 atom %; 2≦Sn≦8 atom %; 0.5<Zn≦5.0 atom %, preferably from 0.8≦Zn≦5.0 atom %; 8≦P≦15 atom %; remainder copper and incidental impurities;
- producing an amorphous brazing foil by rapid solidification of the melt on a moving cooling surface at a cooling rate of more than approx. $10^{5\circ}$ C./sec;
- forming a soldering composite by introducing the brazing foil between the metal parts that are to be joined;
- heating the soldering composite to a temperature above the liquidus point of the brazing foil;
- cooling the soldering composite so as to form a brazed join between the metal parts to be joined.

The amorphous brazing powders according to the invention are used for the cohesive joining of two or more metal parts, with the following steps being carried out:

- providing a brazing powder consisting of 3≦Ni≦10 atom %; 2≦Sn≦8 atom %; 0.5<Zn≦5.0 atom %, preferably from 0.8≦Zn≦5.0 atom %; 8≦P≦15 atom %; remainder copper and incidental impurities;
- producing a solder paste from the brazing powder;
- forming a soldering composite by introducing the brazing paste between the metal parts that are to be joined;
- heating the soldering composite to a temperature above the liquidus point of the brazing powder;
- cooling the soldering composite so as to form a brazed join between the metal parts to be joined.

The cohesive joining which has just been described represents brazing using the low-melting copper-based brazing solder according to the invention, by means of which it is possible to achieve perfect brazed joins without any joining defects.

The liquidus point of the brazing solders according to the invention is approximately 650° C. The brazing process according to the invention in particular allows metal parts made from copper and/or copper alloys to be cohesively joined. Copper parts which are assembled into heat exchangers or related products (e.g. charge air coolers or oil coolers) may typically be considered.

Then, at the soldering temperature, the liquefied amorphous brazing foils wet the metal parts that are to be joined, and additions of zinc completely fill the soldering gap through capillary forces, so that there are no defects in the joins caused by surface oxidation of the brazing foils used.

The invention is described in detail below on the basis of examples and comparative examples.

Table 1 shows comparison results relating to the surface oxidation which occurs just 1 hour after production and 2 weeks after storage at 21° C. and a relative atmospheric humidity of 40%.

TABLE 1

| Alloy | | Cu | Ni | Sn | Zn | P | Surface oxidation 1 hour after production | Surface oxidation after storage for 2 weeks at 21° C. and 40% atmospheric humidity |
|---|---|---|---|---|---|---|---|---|
| 1 | wt. % | Remainder | 5.7 | 9.0 | 0 | 6.2 | Strip is oxidized to | Bright golden-yellow with large |
| | at. % | Remainder | 6.0 | 4.7 | 0 | 12.4 | a gold color, with | bluish and greenish areas, |

TABLE 1-continued

| Alloy | | Cu | Ni | Sn | Zn | P | Surface oxidation 1 hour after production | Surface oxidation after storage for 2 weeks at 21° C. and 40% atmospheric humidity |
|---|---|---|---|---|---|---|---|---|
| | | | | | | | local brown, violet and bluish areas | which in some cases extend over entire sections of the strip |
| 2 | wt. % | Remainder | 10.0 | 9.4 | 0 | 6.7 | Strip is oxidized to a gold color, with local brown, greenish and bluish areas | Bright golden-yellow with bluish and greenish areas, which in some cases extend over entire sections of the strip |
| | at. % | Remainder | 10.5 | 4.9 | 0 | 13.3 | | |
| 3 | wt % | Remainder | 5.7 | 11.6 | 0 | 6.5 | Strip is oxidized to a gold color, with local brown and bluish areas | Golden-yellow with dark violet and blue discolorations, which in some cases extend over entire sections of the strip |
| | at. % | Remainder | 6.0 | 6.1 | 0 | 13.1 | | |
| 4 | wt. % | Remainder | 5.7 | 9.3 | 0 | 6.5 | Oxidized to a gold color with violet discolorations | Bright golden-yellow with bluish and greenish areas, which in some cases extend over entire sections of the strip |
| | at. % | Remainder | 6.0 | 4.8 | 0 | 12.9 | | |
| 5 | wt. % | Remainder | 5.8 | 9.2 | 0 | 5.0 | Gold-colored with brown and violet discolorations | Golden-yellow with dark violet and blue discolorations, which in some cases extend over entire sections of the strip |
| | at. % | Remainder | 6.2 | 4.8 | 0 | 10.1 | | |
| 6 | wt. % | Remainder | 5.7 | 9.0 | 0.6 | 6.5 | The whole strip is metallic and shiny | The whole strip is metallic and shiny |
| | at. % | Remainder | 6.0 | 4.8 | 0.6 | 13.0 | | |
| 7 | wt. % | Remainder | 5.7 | 9.3 | 0.8 | 6.5 | The whole strip is metallic and shiny | The whole strip is metallic and shiny |
| | at. % | Remainder | 6.0 | 4.8 | 0.8 | 13.0 | | |
| 8 | wt. % | Remainder | 5.7 | 9.3 | 1.0 | 6.5 | The whole strip is metallic and shiny | The whole strip is metallic and shiny |
| | at. % | Remainder | 6.0 | 4.8 | 1.0 | 13.0 | | |
| 9 | wt. % | Remainder | 5.7 | 9.3 | 1.5 | 6.5 | The whole strip is metallic and shiny | The whole strip is metallic and shiny |
| | at. % | Remainder | 6.0 | 4.8 | 1.4 | 12.9 | | |
| 10 | wt. % | Remainder | 5.7 | 9.3 | 2.5 | 6.5 | The whole strip is metallic and shiny | The whole strip is metallic and shiny |
| | at. % | Remainder | 6.0 | 4.8 | 2.4 | 13.0 | | |

The brazing foils numbered 1 to 5 are brazing foils in accordance with the prior art, whereas the brazing foils numbered 6 to 10 are brazing foils in accordance with the present invention.

As can be seen from Table 1, the brazing foils of the prior art had extensive signs of oxidation immediately, i.e. just 1 hour after production. Brownish, greenish and/or bluish discolorations, which were initially visible on a local basis, were recorded.

After being stored for 2 weeks, these local discolorations had spread out over wide parts of the strip, which meant that relatively large parts of the strip were then golden-yellow with bluish and greenish discolorations.

By contrast, the six alloys according to the present invention had a metallic silvery shine without any discoloration both immediately after production and after storage for two weeks at 21° C. and a relative atmospheric humidity of 40%.

BRIEF DESCRIPTION OF THE DRAWINGS

The resistance to oxidation was also tested quantitatively on the basis of various exemplary embodiments of the present invention and comparative examples from the prior art. This quantitative determination is presented below with reference to five figures, in which.

DETAILED DESCRIPTION

The amorphous brazing foils shown in FIGS. 1 to 4 were produced by rapid solidification and were at least 50% amorphous. The brazing foils tested had a width B=60 mm and a thickness D=25 μm. Portions with a length of 100 mm were cut from the brazing foils.

These cut foil portions were then annealed in air at an annealing temperature of 175° C. The oxidation which does or does not occur at the surfaces of the brazing foils tested was quantified as increase in mass by weighing the individual specimens.

Figure 1:
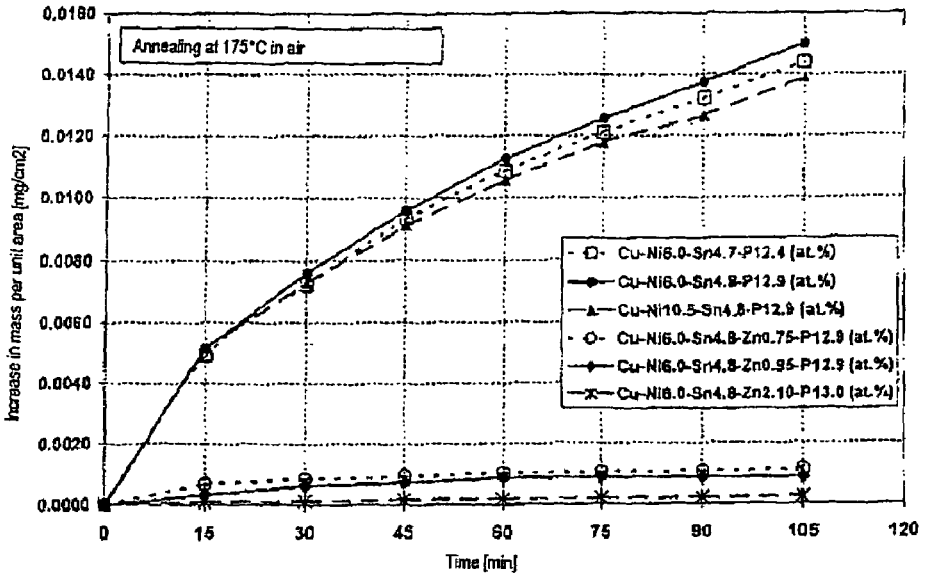
FIG. 1 shows the surface oxidation at an annealing temperature of 175° C. as a function of the annealing time in air, measured as increase in mass per unit foil area of zinc-free and zinc-containing amorphous brazing foils.

As can be seen from FIG. 1, the brazing foils with a zinc content of more than 0.5 atom % had a significantly improved resistance to oxidation. It can also be seen from FIG. 1 that brazing foils from the prior art were still being oxidized continuously even after annealing times of more than 105 minutes. The zinc-containing brazing foils according to the present invention shown in FIG. 1, by contrast, did not exhibit any further increase in mass after an annealing time of approximately 30 minutes.

Figure 2:
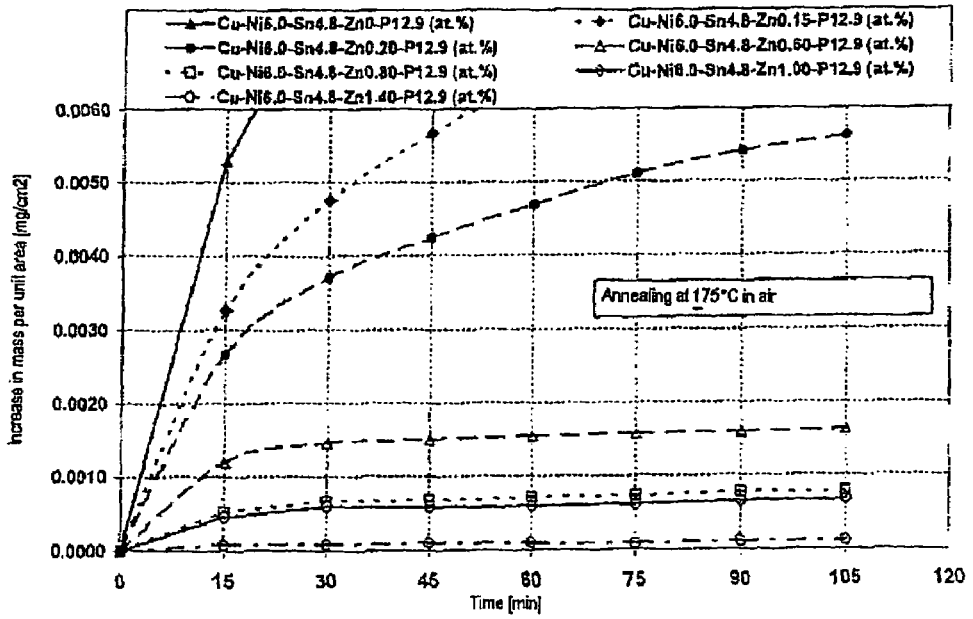
FIG. 2 shows the surface oxidation at an annealing temperature of 175° C. as a function of the annealing time in air, measured as increase in mass per unit foil area with the zinc content varying.

In FIG. 2, the zinc contents were varied from zinc-free to a zinc content of 1.4 atom %. It can be seen from FIG. 2 that brazing foils with a zinc content below 0.5 atom % were still continuously increasing in mass per unit foil area even after an annealing time of 105 minutes. These foils appear to continue to be oxidized for a prolonged period of time.

Foils with approximately 0.8 atom % or more of added zinc, however, appear to be "saturated", as it were, after an annealing time of just 30 or 45 minutes, so that there is no further oxidation.

Figure 3:
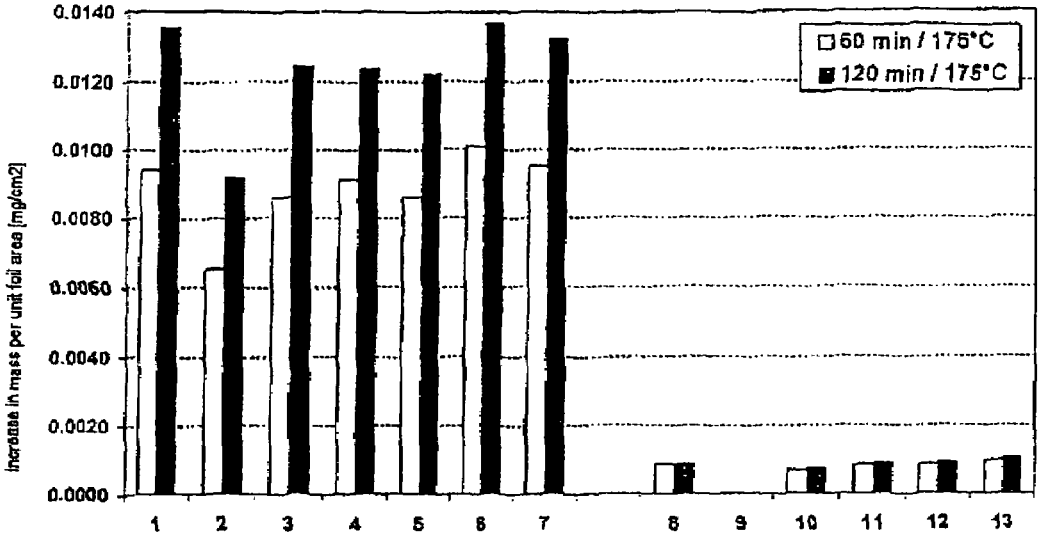
FIG. 3 shows the surface oxidation at an annealing temperature of 175° C. as a function of the annealing time in air, measured as increase in mass per unit foil area of zinc-free and zinc-containing, at least partially amorphous foils.

FIG. 3 shows the oxidation of further foils of zinc-free and zinc-containing alloy compositions, which is measured by the increase in mass after an annealing treatment at 175° C. in air for respectively 60 and 120 minutes. It can be seen from FIG. 3 that all the foils which have an addition of zinc in accordance with the invention have a significantly improved resistance to oxidation.

Figure 4:
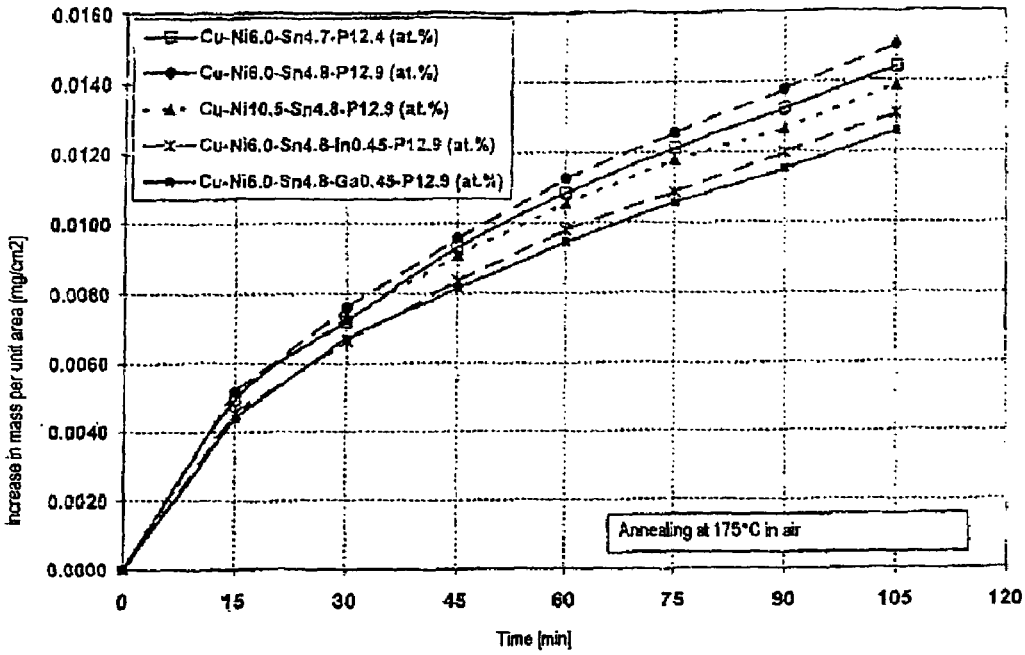
FIG. 4 shows the surface oxidation at an annealing temperature of 175° C. as a function of the annealing time in air, measured as increase in mass per unit foil area of zinc-free brazing foil, an indium-containing brazing foil and a gallium-containing brazing foil.

Finally, it can be seen from FIG. 4 that the use of other additions, in particular additions of indium and gallium, does not improve the resistance to oxidation.

In addition to brazing foils, the brazing alloys according to the invention can also be produced as brazing powders. The brazing powders with the compositions according to the invention can be processed to form solder pastes.

Figure 5:
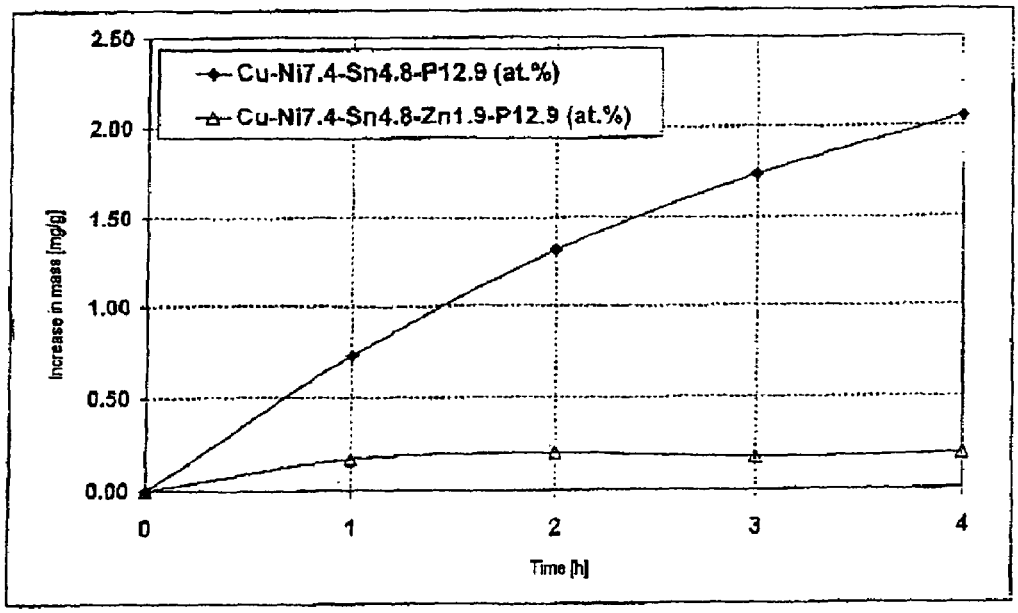
FIG. 5 shows the oxidation at an annealing temperature of 175° C. as a function of the annealing time in air, measured as increase in mass per gram of zinc-free and zinc-containing alloy powders.

Brazing powders are typically produced by gas atomization and have a diameter of between 36 and 45 μm, with the $d_{50}$ value 38 μm. The powders are then subjected to accelerated storage in air at 175° C. for 60 and 120 minutes, respectively. It can be seen from FIG. 5 that adding Zn to the Cu—Ni—Sn—P alloying powder, as in the case of the foil, also leads to a significantly improved resistance to oxidation, specifically to an increase in mass of less than 0.50 mg/g, in particular of less than 0.25 mg/g, after annealing in air at an annealing temperature T=175° C. for an annealing time of 60 min, without any further increase in mass taking place after a further 180 min.

What we claim is:

1. A brazing alloy with a composition consisting of $$Ni_aSn_bZn_cP_dCu_{Remainder}$$

where 2≦a≦20 atom %; 2≦b≦12 atom %; c>0.5 atom %; 6≦d≦16 atom %; remainder copper and incidental impurities, with the total amount of copper, nickel, tin and zinc being between 80 and 95 atom %.

2. The brazing alloy as claimed in claim 1, with a composition consisting of $$Ni_aSn_bZn_cP_dCu_{Remainder}$$

where 3≦a≦10 atom %; 2≦b≦8 atom %; c>0.8 atom %; 8≦d≦15 atom %; remainder copper and incidental impurities.

3. A homogenous, ductile brazing foil with a composition consisting of $$Ni_aSn_bZn_cP_dCu_{Remainder}$$

where 2≦a≦20 atom %; 2≦b≦12 atom %; 0.5<c≦5.0 atom %; 6 d≦16 atom %; remainder copper and incidental impurities, with the total amount of copper, nickel, tin and zinc being between 80 and 95 atom %.

4. The homogenous, ductile brazing foil as claimed in claim 3, with a composition consisting of $$Ni_aSn_bZn_cP_dCu_{Remainder}$$

where 3≦a≦10 atom %; 2≦b≦8 atom %; 0.8≦c≦3.0 atom %; 8≦d≦15 atom %; remainder copper and incidental impurities, with the total amount of copper, nickel, tin and zinc being between 80 and 95 atom %.

5. The brazing foil as claimed in claim 3, characterized by an increase in mass per unit foil area of less than 0.003 $mg/cm^2$ after annealing in air at an annealing temperature T=175° C. and for an annealing time of 60 min.

6. The brazing foil as claimed in claim 5, characterized by an increase in mass per unit foil area of less than 0.002 $mg/cm^2$ after annealing in air at an annealing temperature T=175° C. and for an annealing time of 60 min.

7. The brazing foil as claimed in claim 3, characterized in that the brazing foil is at least 80% amorphous.

8. The brazing foil as claimed in claim 3, characterized by a thickness 25 μm≦D≦100 μm.

9. The brazing foil as claimed in claim 3, characterized by a width 40 mm≦B≦300 mm.

10. The brazing foil as claimed in claim 7, characterized by a width B≦60 mm.

11. A brazing powder with a composition consisting of $$Ni_aSn_bZn_cP_dCu_{Remainder}$$

where 2≦a≦20 atom %; 2≦b≦12 atom %; 0.5<c≦5.0 atom %; 6 d≦16 atom %; remainder copper and incidental impurities, with the total amount of copper, nickel, tin and zinc being between 80 and 95 atom %.

12. The brazing powder as claimed in claim 11, with a composition consisting of $$Ni_aSn_bZn_cP_dCu_{Remainder}$$

where 3≦a≦10 atom %; 2≦b≦8 atom %; 0.8≦c≦3.0 atom %; 8≦d≦15 atom %; remainder copper and incidental impurities, with the total amount of copper, nickel, tin and zinc being between 80 and 95 atom %.

13. The brazing powder as claimed in claim 11, wherein the brazing powder has a diameter of between 38 μm and 45 μm.

14. The brazing powder as claimed in claim 12, wherein the brazing powder has a diameter of between 38 μm and 45 μm.

15. The brazing powder as claimed in claim 11, wherein the brazing powder comprises a solder paste.

16. The brazing powder as claimed in claim 11, wherein the powder has an increase in mass of less than 0.50 mg/g after annealing in air at an annealing temperature T=175° C. and for an annealing time of 60 min.

* * * * *